US010899151B1

(12) United States Patent
Asahi

(10) Patent No.: US 10,899,151 B1
(45) Date of Patent: Jan. 26, 2021

(54) INFORMATION MANAGEMENT SYSTEM, INFORMATION MANAGEMENT METHOD, AND CARTRIDGE

(71) Applicant: TOSHIBA TEC KABUSHIKI KAISHA, Tokyo (JP)

(72) Inventor: Toshihiko Asahi, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/534,232

(22) Filed: Aug. 7, 2019

(51) Int. Cl.
*B41J 29/393* (2006.01)
*B41J 2/175* (2006.01)

(52) U.S. Cl.
CPC ..... *B41J 29/393* (2013.01); *B41J 2/17533* (2013.01); *B41J 2/17546* (2013.01); *B41J 2029/3937* (2013.01)

(58) Field of Classification Search
CPC ..... B41J 2/0451; B41J 2/04586; B41J 2/175; B41J 2/17533; B41J 2/17546; B41J 2029/3937; B41J 29/393
See application file for complete search history.

(56) References Cited

U.S. PATENT DOCUMENTS 8,066,350 B2 * 11/2011 Yoshida ..... B41J 2/17546 347/22
9,116,492 B2 8/2015 Kawana

* cited by examiner

*Primary Examiner* — Thinh H Nguyen
(74) *Attorney, Agent, or Firm* — Amin, Turocy & Watson LLP

(57) ABSTRACT

According to one embodiment, an information management system includes a storage device and a control unit. The storage device is provided in a management server communicatively connected to an image forming apparatus to which a cartridge having a consumable item is detachably attached, via a network, and stores information on the consumable item or the cartridge. The control unit limits a predetermined function related to image formation of the image forming apparatus when, based on identification information indicating the cartridge stored in a cartridge storage device provided in the cartridge attached to the image forming apparatus, information on the consumable item or the cartridge is acquired from the storage device, and the acquired information satisfies a predetermined condition indicating that the cartridge is not a genuine cartridge.

20 Claims, 5 Drawing Sheets

| CARTRIDGE IDENTIFICATION INFORMATION | CONSUMPTION COUNTER VALUE | IMAGE FORMING APPARATUS IDENTIFICATION INFORMATION |
|---|---|---|
| 100 | 8800 | 5001 |

| CARTRIDGE IDENTIFICATION INFORMATION | CONSUMPTION COUNTER VALUE | IMAGE FORMING APPARATUS IDENTIFICATION INFORMATION |
|---|---|---|
| 10 | 6500 | 6001 |
| 100 | 8800 | 5001 |
| . . . | . . . | . . . |

INFORMATION MANAGEMENT SYSTEM, INFORMATION MANAGEMENT METHOD, AND CARTRIDGE

FIELD

Embodiments described herein relate generally to an information management system, an information management method, and a cartridge.

BACKGROUND

In recent years, image forming apparatuses perform control related to consumable items. For example, an IC chip is applied to a cartridge containing a developer such as toner which is one of consumable items. Then, in the IC chip, control related to a developer is performed by recording information on the developer. However, there is a case where a cartridge is distributed in which the information on a developer is recorded in the IC chip by illegal manners. In the system of the related art, there is a case where such an abnormal cartridge cannot be detected and control related to a developer cannot be appropriately performed.

DETAILED DESCRIPTION

In general, according to one embodiment, an information management system includes a storage device and a control unit. The storage device is provided in a management server communicatively connected to an image forming apparatus to which a cartridge having a consumable item is detachably attached, via a network, and stores information on the consumable item or the cartridge. The control unit limits a predetermined function related to image formation of the image forming apparatus when, based on identification information indicating the cartridge stored in a cartridge storage device provided in the cartridge attached to the image forming apparatus, information on the consumable item or the cartridge is acquired from the storage device, and the acquired information satisfies a predetermined condition indicating that the cartridge is not a genuine cartridge.

Figure 1:
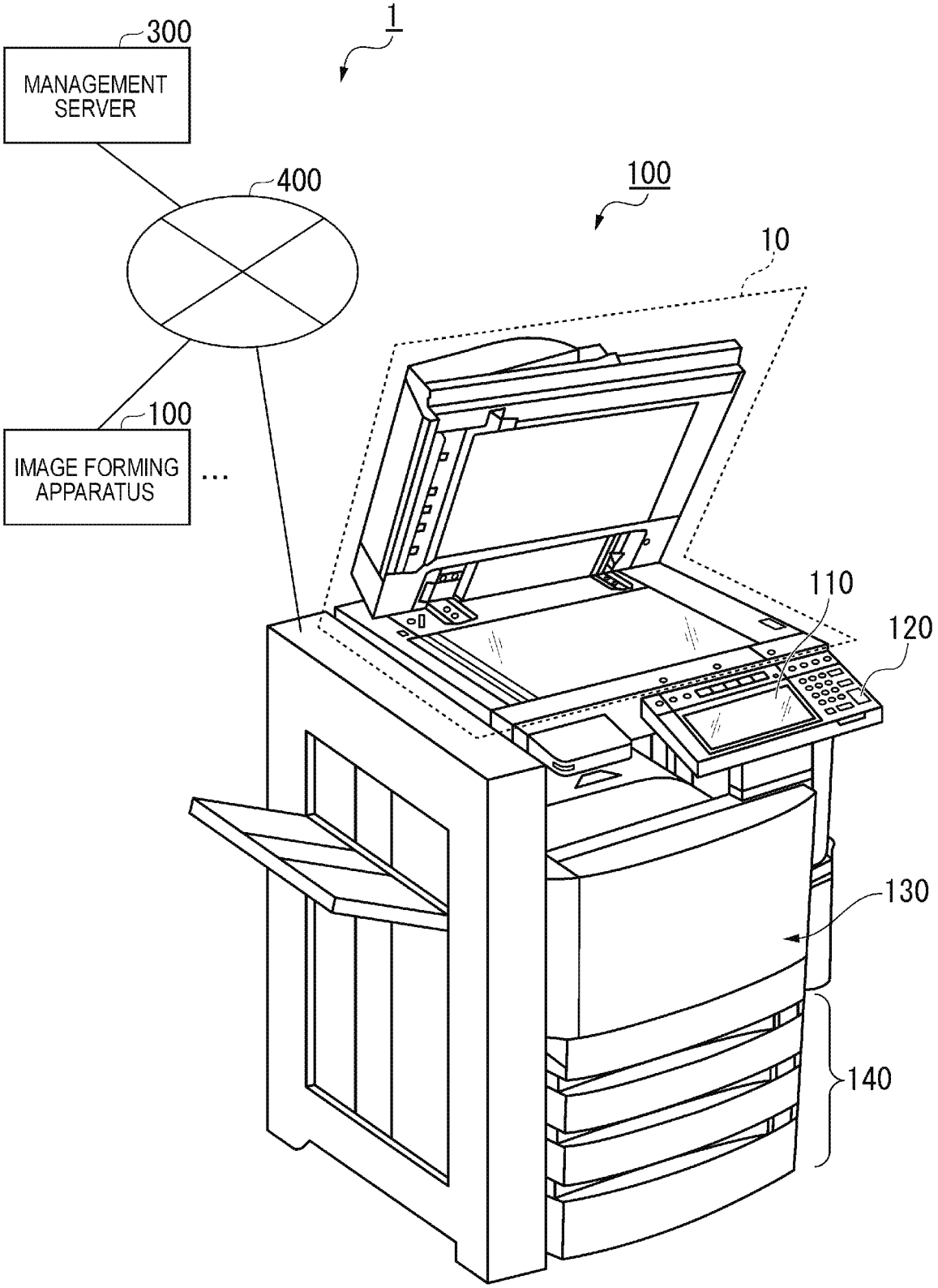
FIG. 1 is a diagram showing an example of the configuration of an information management system according to an embodiment.

Hereinafter, an information management system, an information management method, and a cartridge according to the embodiments will be described with reference to the drawings. FIG. 1 is a diagram showing an example of the configuration of an information management system 1 according to an embodiment. The information management system 1 includes one or more image forming apparatuses 100 and a management server 300. The image forming apparatus 100 is an apparatus for forming an image on a sheet using consumable items. The image forming apparatus 100 is, for example, a multifunction peripheral. The management server 300 is an information processing apparatus that stores information on the consumable items used in each of the image forming apparatuses 100. The image forming apparatus 100 and the management server 300 are communicably connected to each other via a network 400. Each device will be described in detail below.

Figure 2:
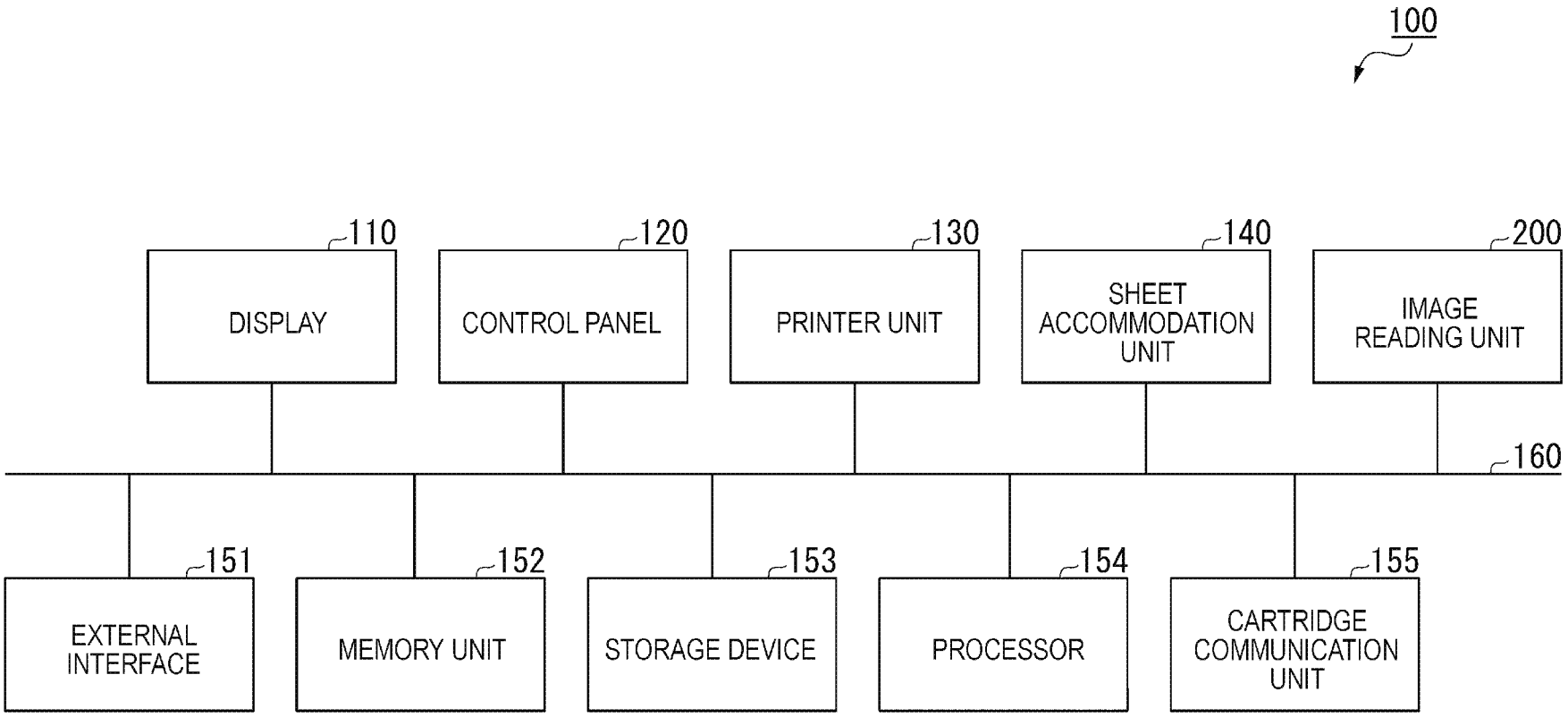
FIG. 2 is a hardware block diagram of an image forming apparatus.

FIG. 2 is a hardware block diagram of the image forming apparatus 100 according to the embodiment. First, the image forming apparatus 100 will be described in detail using FIGS. 1 and 2. The image forming apparatus 100 includes a display 110, a control panel 120, a printer unit 130, a sheet accommodating unit 140, an external interface 151, a memory unit 152, a storage device 153, a processor 154, a cartridge communication unit 155, and an image reading unit 200. The printer unit 130 of the image forming apparatus 100 may be an apparatus for fixing a toner image, or an ink jet apparatus. Each functional unit is connected so as to be capable of performing data communication via a system bus 160.

The image forming apparatus 100 forms an image on a sheet using a developer such as toner or ink. When the developer is a toner, the developer is fixed on the sheet by heating. When the developer is an ink, the developer is dropped onto the sheet to form an image on the sheet. The sheet is, for example, paper or label paper. The sheet may be any sheet as long as the image forming apparatus 100 can form an image on its surface. Examples of the toner include a decoloring toner, a non-decoloring toner (normal toner), a decorative toner and the like. The developer is one of the specific examples of consumable items used in the image forming apparatus 100. The developer is contained in a cartridge which is a specific container.

The cartridge stores consumable items used in the image forming apparatus 100 and is configured to be removable (detachably attachable) from the image forming apparatus 100. The cartridge includes a cartridge storage device. The cartridge storage device stores cartridge information. The cartridge information includes information on consumable items such as the stored developer and information on the cartridge. The cartridge information includes, for example, identification information given to the cartridge in advance (hereinafter, referred to as "cartridge identification information").

The display 110 is an image display device such as a liquid crystal display or an organic electro luminescence (EL) display. The display 110 displays various types of information on the image forming apparatus 100.

The control panel 120 has a plurality of buttons. The control panel 120 receives an operation of the user. The control panel 120 outputs a signal corresponding to the operation performed by the user to the control unit of the image forming apparatus 100. The display 110 and the control panel 120 may be configured as an integral touch panel.

The printer unit 130 forms an image on a sheet based on image information generated by the image reading unit 200 or image information received via a communication path. For example, the printer unit 130 forms an image by the following process. An image forming unit of the printer unit 130 forms an electrostatic latent image on a photosensitive drum based on the image information. The image forming unit of the printer unit 130 forms a visible image by applying a developer to the electrostatic latent image. A transfer unit of the printer unit 130 transfers the visible image onto the sheet. A fixing unit of the printer unit 130 fixes the visible image on the sheet by heating and pressing the sheet. The sheet on which the image is formed may be a sheet stored in the sheet accommodating unit 140 or a sheet inserted by hand.

The sheet accommodating unit 140 stores a sheet used for image formation in the printer unit 130.

The external interface 151 is configured by using a communication interface. The external interface 151 communicates with other devices (for example, the management server 300) via the network 400 according to a predetermined protocol.

The memory unit 152 temporarily stores data used by each functional unit included in image forming apparatus 100. The memory unit 152 is, for example, a random access memory (RAM). The memory unit 152 stores data required when the image forming apparatus 100 is operated. The memory unit 152 may temporarily store digital data generated by the image reading unit 200. The memory unit 152 may temporarily store data of an image formed in the image forming apparatus 100.

The storage device 153 is configured by using a storage device such as a magnetic hard disk device or a semiconductor storage device. The storage device 153 stores data required when the image forming apparatus 100 is operated. The storage device 153 stores, for example, cartridge information on the cartridge attached to the image forming apparatus 100. For example, the storage device 153 stores a threshold described later.

The processor 154 controls the operation of each functional unit of the image forming apparatus 100. The processor 154 loads a software program stored in the storage device 153 onto the memory unit 152, and executes the process by executing the software program.

The cartridge communication unit 155 is configured by using a communication interface. The cartridge communication unit 155 communicates with the cartridge storage device attached to the own apparatus (image forming apparatus 100). The cartridge communication unit 155 acquires information recorded in the cartridge storage device by communicating with the cartridge storage device. The cartridge communication unit 155 communicates with the cartridge storage device to write new information in the cartridge storage device. The cartridge communication unit 155 communicates with the cartridge storage device to delete the recorded information. The cartridge communication unit 155 may communicate with the cartridge storage device using, for example, short distance wireless communication (for example, RFID). The cartridge communication unit 155 may perform wired communication (contact communication, such as IC chip) via, for example, a terminal provided on the cartridge.

The image reading unit 200 reads image information to be read as brightness and the darkness of light. The image reading unit 200 records the read image information. The recorded image information may be transmitted to another information processing apparatus via the network. The recorded image information may be used to form an image on the sheet by the printer unit 130.

Figures 3, 4, 5:
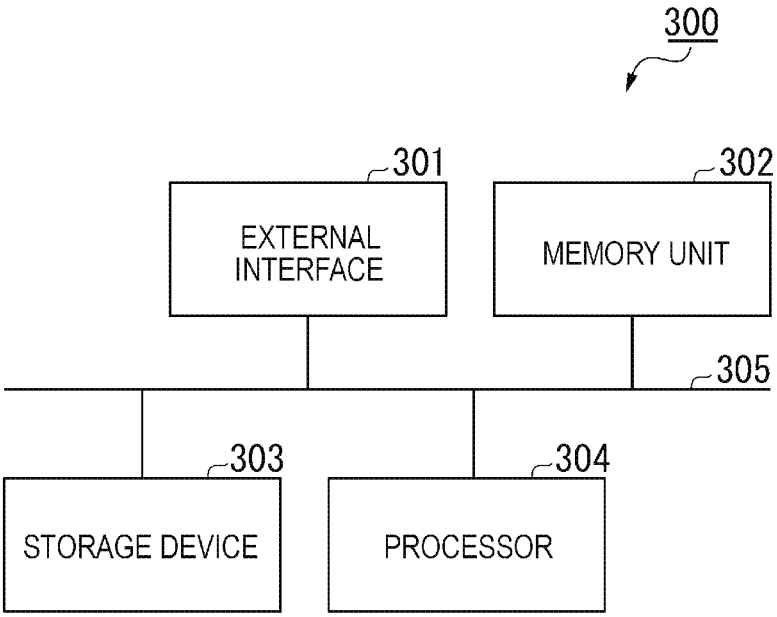
FIG. 3 is a diagram showing a specific example of cartridge information.
FIG. 4 is a block diagram showing a hardware configuration of a management server.
FIG. 5 is a diagram showing a specific example of a cartridge information table.

FIG. 3 is a diagram showing a specific example of cartridge information of the embodiment. The cartridge information is information on consumable items or the cartridge. The cartridge information has, for example, each value of cartridge identification information, a consumption counter value, and image forming apparatus identification information. The cartridge information is information that is updated each time the consumable item of the cartridge is used. The cartridge identification information is cartridge identification information given to the cartridge storage device that stores the cartridge identification information. The consumption counter value is a value indicating the consumption of the consumable item used in the image forming apparatus 100 to which the cartridge is attached. The consumable item counter value may be a value indicating the number of uses of the consumable item used in the image forming apparatus 100 to which the cartridge is attached. The consumption counter value may have a value corresponding to the consumable item. The image forming apparatus identification information is identification information of the image forming apparatus 100 to which the cartridge is attached.

In the example shown in FIG. 3, the cartridge information has "100" as the value of the cartridge identification information. The cartridge information has "8800" as the value of the consumption counter value. The cartridge information has "5001" as the value of the image forming apparatus identification information. In addition, the cartridge information shown in FIG. 3 is only one specific example. Therefore, the cartridge information may be configured in a mode different from FIG. 3. For example, the cartridge information may have a column indicating the type of consumable item such as a developer.

FIG. 4 is a block diagram showing the hardware configuration of the management server 300 of the embodiment. The management server 300 includes an external interface 301, a memory unit 302, a storage device 303, and a processor 304. The respective functional units are connected so as to be capable of performing data communication via a system bus 305.

The external interface 301 is configured by using a communication interface. The external interface 301 communicates with another apparatus (for example, the image forming apparatus 100) via the network 400 according to a predetermined protocol.

The memory unit 302 temporarily stores data used by each functional unit included in the management server 300. The memory unit 302 is, for example, a RAM. The memory unit 302 stores data required when the management server 300 is operated.

The storage device 303 is configured by using a storage device such as a magnetic hard disk device or a semiconductor storage device. The storage device 303 stores data required when the management server 300 is operated. The storage device 303 stores, for example, a cartridge information table. The cartridge information table holds information on the cartridge attached to the image forming apparatus communicably connected to the management server 300. The cartridge information table is updated each time a consumable item attached to the image forming apparatus 100 communicably connected to the management server 300 is used.

The processor 304 controls the operation of each functional unit of the management server 300. The processor 304 loads a software program stored in the storage device 303 onto the memory unit 302, and executes the process by executing the software program.

FIG. 5 is a diagram showing a specific example of the cartridge information table of the embodiment. The cartridge information table stores one or more cartridge information records. The cartridge information record has, for example, each value of cartridge identification information, consumption counter value, and image forming apparatus identification information. Each of these values has the same content as the cartridge information stored in the cartridge storage device, and thus the description thereof is omitted.

Each value of the cartridge information record is information on the cartridge or the consumable item attached to the image forming apparatus 100. The image forming apparatus 100 is identified by the image forming apparatus identification information held by the cartridge information record. Each value of the cartridge information record is updated each time the consumable item of the cartridge attached to a predetermined image forming apparatus 100 is used. The predetermined image forming apparatus 100 is the image forming apparatus 100 identified by the image forming apparatus identification information held by the cartridge information record.

In the example shown in FIG. 5, the cartridge information record in the uppermost stage of the cartridge information table has "10" as the value of the cartridge identification information. The cartridge information record has "6500" as the value of the consumption counter value. The cartridge information record has "6001" as the value of the image forming apparatus identification information. In addition, the cartridge information table shown in FIG. 5 is merely a specific example. Therefore, the cartridge information table may be configured in a mode different from FIG. 5. For example, the cartridge information table may have a column indicating the type of consumable item such as a developer.

Figure 6:
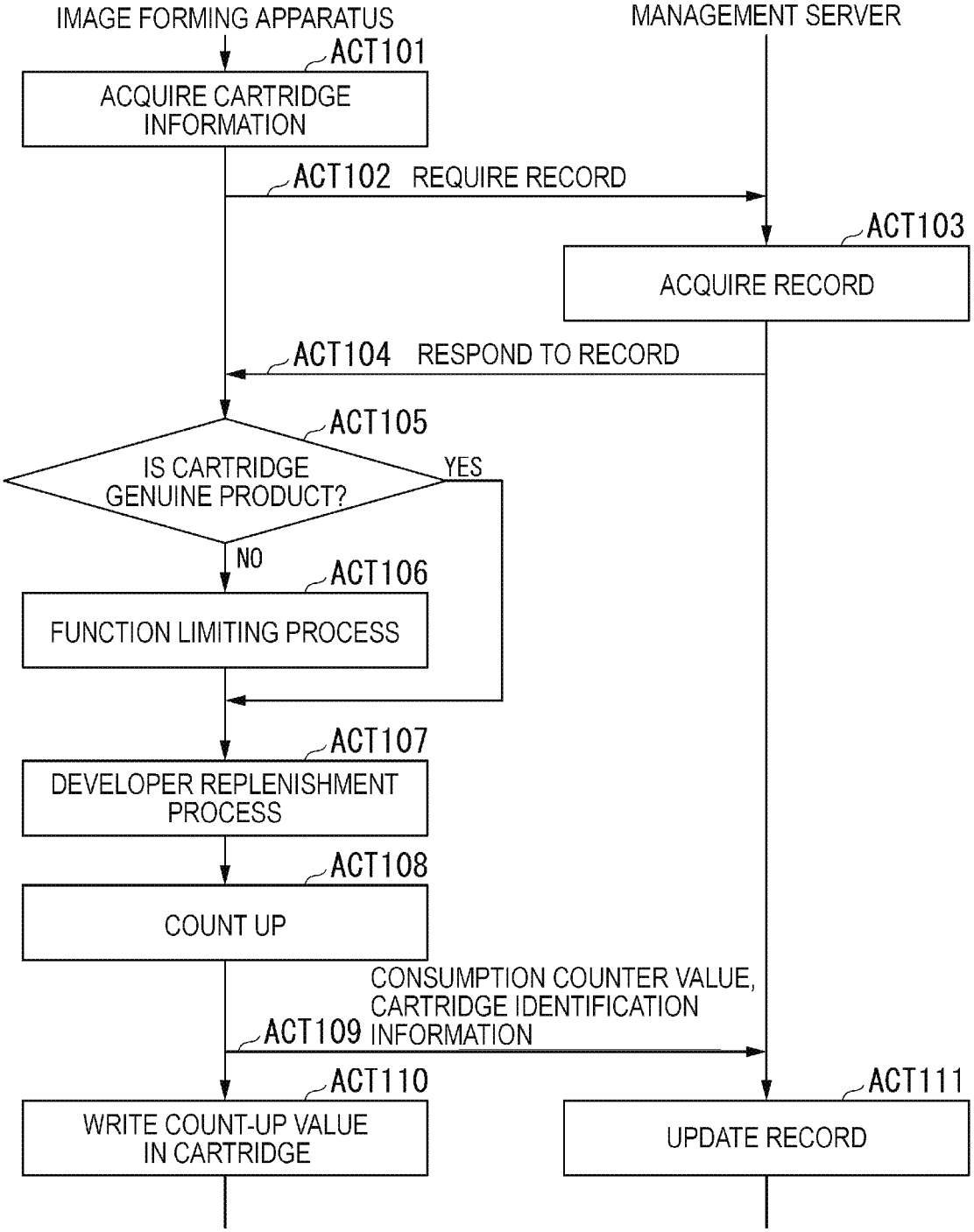
FIG. 6 is a sequence diagram showing a flow of a first specific example of a genuine product determination process performed by the information management system.

FIG. 6 is a sequence diagram showing a flow of a first specific example of the genuine product determination process executed by the information management system 1 of the embodiment. The information management system. 1 executes the genuine product determination process when a predetermined determination timing comes. The predetermined determination timing is the timing at which the condition related to the use of the developer stored in the cartridge is satisfied. The condition related to the use of the developer may be, for example, the timing at which the developer is replenished to the image forming apparatus 100. The conditions related to the use of the developer may be, for example, the timing at which the cartridge is already replaced, and the conditions related to the use of the developer may be, for example, after the end of the image formation or before the start of the image formation.

When the timing of the genuine product determination process comes, the processor 154 of the image forming apparatus 100 acquires cartridge information stored in the cartridge storage device (ACT 101). The processor 154 acquires cartridge information by the following process, for example. The processor 154 instructs the cartridge communication unit 155 to read out cartridge information. The cartridge communication unit 155 reads out the cartridge information stored in the cartridge storage device by communicating with the cartridge storage device according to the instruction. The cartridge communication unit 155 outputs the read cartridge information to the processor 154. The processor 154 acquires cartridge information by receiving cartridge information from the cartridge communication unit 155.

The processor 154 requests the management server 300 for a predetermined cartridge information record (ACT 102). The processor 154 requests the cartridge information record by the following process, for example. The processor 154 acquires cartridge identification information from the acquired cartridge information. The processor 154 associates the acquired cartridge identification information with the request, and transmits the information to the management server 300. Thus, the processor 154 requests the cartridge information record from the management server 300.

The processor 304 of the management server 300 acquires a cartridge information record (ACT 103). For example, the processor 304 reads the cartridge information table stored in the storage device 303. The processor 304 reads a cartridge information record holding a value of predetermined cartridge identification information from the cartridge information table. The predetermined cartridge identification information is cartridge identification information transmitted from the image forming apparatus 100. Thus, the processor 304 acquires the cartridge information record.

The processor 304 transmits the cartridge information record acquired by responding to the image forming apparatus 100 (ACT 104). However, when the desired cartridge information record is not held in the cartridge information table, the processor 304 does not acquire the cartridge information record. The desired cartridge information record is a cartridge information record having the value of the cartridge identification information transmitted from the image forming apparatus 100. In this case, the processor 304 responds to the image forming apparatus 100 not to hold the cartridge information record in the cartridge information table.

The processor 154 determines whether or not the cartridge attached to the image forming apparatus 100 is a genuine product (ACT 105). For example, when the processor 154 receives a response indicating that the cartridge information record is not held, the processor 154 may determine that the cartridge is not a genuine product. On the other hand, when the processor 154 receives the response indicating that the cartridge information record is held from the management server 300, the processor 154 may determine that the product is a genuine product.

When the cartridge is a genuine product (ACT 105: YES), the processor 154 executes ACT 107. When the cartridge is not a genuine product (ACT 105: NO), the processor 154 performs a function limiting process (ACT 106). The function limiting process is a process of limiting a predetermined function related to the developer of the image forming apparatus 100 or image formation. The function limiting process may be, for example, a process of stopping the display of the remaining amount of the developer. The function limiting process may be, for example, a process of reducing the speed of image formation below the rated speed. The function limiting process may be, for example, a process of limiting a function of suppressing or increasing the amount of the developer used for image formation or the like.

The processor 154 performs a developer replenishment process (ACT 107). The processor 154 supplies the developer stored in the cartridge to the developing device by driving a developer supply motor. The processor 154 counts up the consumption counter value (ACT 108). The processor 154 acquires the consumption counter value from the cartridge information record. The processor 154 counts up the consumption counter value according to the consumed amount of the consumable item. Counting-up is to add information indicating that the consumable item is further used to the consumption counter value. For example, the counting up may increment the consumption counter value according to the use of the consumable item. For example, the processor 154 may count up the consumption counter value according to the number of rotations of the developer supply motor. For example, the processor 154 may count up the counter value according to the number of sheets on which an image is formed. For example, the processor 154 may count up the counter value according to the number of jobs in which an image is formed. Although the processor 154 counts up the consumption counter value held in the cartridge information record, the embodiment is not limited thereto. For example, the processor 154 may count up the consumption counter value held in the cartridge storage device.

The processor 154 transmits the counted-up consumption counter value and the cartridge identification information to the management server 300 (ACT 109). The cartridge communication unit 155 records the counted-up consumption counter value in the cartridge storage device (ACT 110). The processor 154 records the consumption counter value in the cartridge information by the following process, for example. The processor 154 instructs the cartridge communication unit 155 to write the consumption counter value. The cartridge communication unit 155 writes the consumption counter value to the cartridge storage device by communicating with the cartridge storage device according to the instruction. When the consumption counter value is already stored in the cartridge storage device, the cartridge communication unit 155 deletes the stored consumption counter value. The cartridge communication unit 155 writes the consumption counter value after the consumption counter value is deleted.

The processor 304 updates the cartridge information record based on the received consumption counter value (ACT 111). The processor 304 updates the cartridge information record by the following process, for example. The processor 304 acquires the cartridge information table from the storage device 303. The processor 304 acquires a cartridge information record that holds the value of the cartridge identification information. The processor 304 performs update by writing the received consumption counter value to the value of the acquired cartridge information record. The processor 304 records the cartridge information record in which the consumption counter value is written in the cartridge information table. The processor 304 deletes the cartridge information record before the update.

Figure 7:
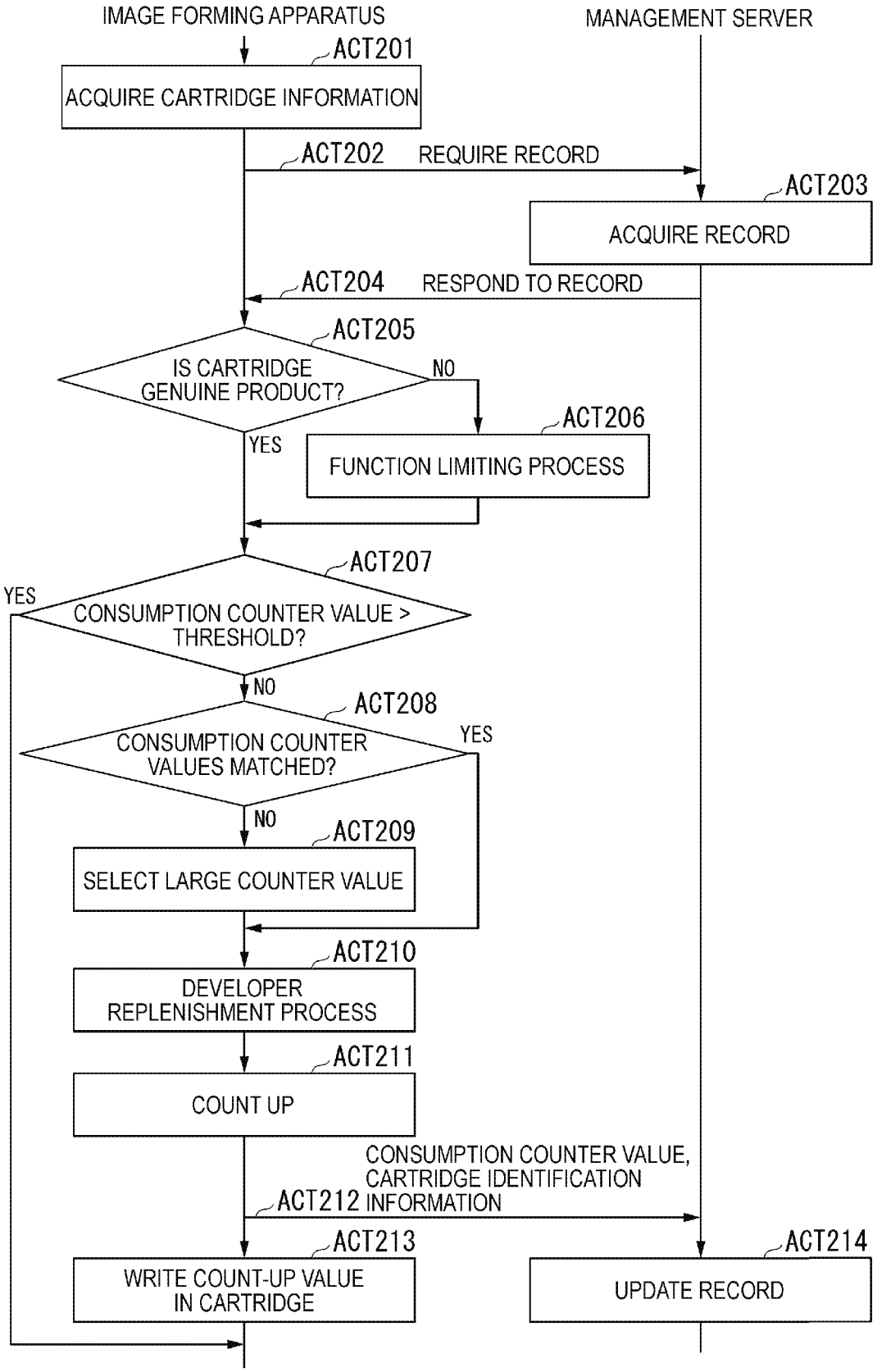
FIG. 7 is a sequence diagram showing a flow of a second specific example of the genuine product determination process executed by the information management system.

FIG. 7 is a sequence diagram showing a flow of a second specific example of the genuine product determination process executed by the information management system 1 of the embodiment. The genuine product determination process executes the genuine product determination process when a predetermined determination timing comes. Since the processes from ACT 201 to ACT 206 are the same as the processes from ACT 101 to ACT 106 in FIG. 6, the description will be omitted. Since the processes from ACT 212 to ACT 214 are the same as the processes from ACT 109 to ACT 111 in FIG. 6, the description will be omitted.

When the cartridge is a genuine product (ACT 205: YES), the processor 154 determines whether or not the consumption counter value is larger than a threshold (ACT 207). The processor 154 performs determination, for example, by the following process. The processor 154 acquires the consumption counter value held in the cartridge information record. The processor 154 acquires the threshold from the storage device 153. The threshold is a value related to the upper limit of the use amount of the consumable item stored in the cartridge. For example, the threshold may be a value corresponding to the amount of the developer stored in one cartridge. For example, the threshold may be a value corresponding to the number of revolutions of the developer supply motor. For example, the threshold may be a value corresponding to the number of sheets on which an image is formed. For example, the threshold may be a value corresponding to the number of jobs in which an image is formed. The threshold may be any value as long as the threshold is expressed in the same unit as the consumption counter value. The processor 154 determines whether or not the consumption counter value is larger than the threshold by comparing the acquired consumption counter value with the threshold or calculating the difference between the consumption counter value and the threshold. The processor 154 may determine whether or not the consumption counter value is larger than the threshold using the consumption counter value stored in the cartridge storage device.

When the consumption counter value is larger than the threshold (ACT 207: YES), the processor 154 ends the process. When the consumption counter value is less than or equal to the threshold (ACT 207: NO), the processor 154 determines whether or not the consumption counter values respectively stored in the cartridge information record and the cartridge storage device are matched (ACT 208). The processor 154 performs determination, for example, by the following process. The processor 154 acquires the consumption counter value held in the cartridge information record. The processor 154 acquires the consumption counter value stored in the cartridge information record. The processor 154 determines whether or not the consumption counter values are matched by comparing the acquired consumption counter values or calculating the difference.

When the consumption counter values are not matched (ACT 208: NO), the processor 154 selects the larger one of the consumption counter values that the cartridge information record and the cartridge storage device respectively have (ACT 209). When the consumption counter values are matched (ACT 208: YES), the processor 154 executes ACT 210. In this case, the processor 154 may select any value among the consumption counter values that the cartridge information record and the cartridge storage device have.

The processor 154 performs the developer replenishment process (ACT 210). The processor 154 supplies the developer stored in the cartridge to the developing device by driving the developer supply motor. The processor 154 counts up the consumption counter value (ACT 211). The processor 154 counts up the selected consumption counter value according to the consumed amount of the consumable item.

In the information management system 1 configured as described above, the image forming apparatus 100 acquires the information stored in the cartridge storage device provided in the cartridge attached to the own apparatus. The image forming apparatus 100 acquires information on a consumable item or a cartridge from the management server 300 based on the acquired information. Based on the acquired information, the image forming apparatus 100 determines whether or not a predetermined condition indicating that the cartridge attached to the own apparatus is not a genuine cartridge is satisfied. The image forming apparatus 100 limits a function related to the developer of the image forming apparatus 100 when it is determined that the cartridge is not a genuine cartridge (a predetermined condition is satisfied). Therefore, the information management system 1 can detect an abnormal cartridge such as a cartridge in which the information stored in the cartridge storage device is recorded by illegal manners. In addition, the information management system 1 limits a function related to the developer when a non-genuine cartridge is attached. With such a configuration, it is possible to suppress the occurrence of a malfunction or failure of the image forming apparatus 100.

Further, the information management system 1 limits a function related to the consumable item in the image forming apparatus 100 when the consumable item consumption counter value and the threshold related to the consumable item satisfy the predetermined conditions. The consumable item consumption counter value used for the determination is a value which is a larger value of the cartridge storage device or the management server 300. With such a configuration, even when a plurality of cartridges having the same information are distributed in duplication or the like, the amount of the used consumable item can be suppressed for one cartridge.

<Modification>

The consumable item may be, for example, a photosensitive drum. In the cartridge of the photosensitive drum used once, the above embodiment may be applied even when a compatible product in which the photosensitive member and the cleaning blade are replaced with non-genuine parts is attached to the image forming apparatus 100 as a new cartridge. The cartridge is not necessarily limited to the embodiment for storing a consumable item. For example, the cartridge may be a device that supports a consumable item (for example, a photosensitive drum). As described above, the consumable item in the embodiment is not necessarily limited to one that disappears due to use, and an item that is deteriorated due to use may be included in the consumable item.

Although the information management system 1 is described as the configuration including the management server 300 in the above-described embodiment, the information management system 1 may have a configuration not including the management server 300. In this case, any one of the plurality of image forming apparatuses may have the function of the management server 300, or may be configured to share functions of the plurality of image forming apparatuses.

The information management system 1 may be configured to manage the remaining amount of the developer stored in the cartridge by the management server 300 when the cartridge is a genuine product. When the cartridge is not a genuine product, the information management system 1 cannot manage the remaining amount of the developer stored in the cartridge and causes a malfunction in some cases. Therefore, when the cartridge is not a genuine product, for example, the remaining amount of the developer may not be managed by performing the following operation. First, when the cartridge is not a genuine product, the image forming apparatus 100 performs a function limiting process. Next, the image forming apparatus 100 supplies the developer stored in the cartridge to the developing device, and the process ends. With such a configuration, the information management system 1 does not update the cartridge information record based on the consumption counter value when the cartridge is not a genuine product. Therefore, the information management system 1 does not have to manage the remaining amount of the developer by the management server 300. Therefore, the information management system 1 does not have to manage the remaining amount of the developer stored in the cartridge, and a malfunction can be prevented.

The management server 300 may be implemented using a plurality of information processing apparatuses communicably connected via the network. In this case, each functional unit included in the management server 300 may be distributed and implemented in a plurality of information processing apparatuses. For example, the storage device 303 and the processor 304 may be respectively mounted on different information processing apparatuses.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An information management system, comprising:

a storage device that is provided in a management server communicatively connected to an image forming apparatus to which a cartridge having a consumable item is detachably attached, via a network, and the storage device stores information on the consumable item or the cartridge; and a control unit that limits a predetermined function related to image formation by the image forming apparatus when, based on identification information indicating the cartridge stored in a cartridge storage device provided in the cartridge attached to the image forming apparatus, information on the consumable item or the cartridge is acquired from the storage device, and the acquired information satisfies a predetermined condition indicating that the cartridge is not a genuine cartridge.

2. The system according to claim 1, wherein the predetermined condition is that the identification information stored in the cartridge storage device is not stored in the storage device.

3. The system according to claim 2, wherein the control unit adds information indicating that the consumable item is used to information indicating that more consumable items are used out of information relating to use of the consumable item that is information stored in the storage device, and information on use of the consumable item that is information stored in the cartridge storage device.

4. The system according to claim 1, wherein the control unit manages information on use of the consumable item in the management server when the cartridge is a genuine cartridge.

5. The system according to claim 4, wherein the control unit limits use of the consumable item when information on the use of the consumable item is larger than the threshold.

6. The system according to claim 1, wherein the control unit limits a function related to the consumable item in the image forming apparatus when information on use of the consumable item included in the cartridge attached to the image forming apparatus and a threshold related to the consumable item satisfy predetermined conditions.

7. The system according to claim 1, wherein the control unit limits a function indicating a consumption state of the consumable item when the cartridge is not a genuine cartridge.

8. The system according to claim 1, wherein the cartridge is a developer storage container, and the consumable item is a developer.

9. An information management method, comprising:

storing information on a consumable item or a cartridge by an information management system provided in a management server communicatively connected to an image forming apparatus to which a cartridge having a consumable item is detachably attached, via a network; and limiting a predetermined function related to image formation of the image forming apparatus by the information management system when, based on identification information indicating the cartridge stored in a cartridge storage device provided in the cartridge attached to the image forming apparatus, information on the consumable item or the cartridge is acquired from the storage device, and the acquired information satisfies a predetermined condition indicating that the cartridge is not a genuine cartridge.

10. The method according to claim 9, wherein the predetermined condition is that the identification information stored in the cartridge storage device is not stored in the storage device.

11. The method according to claim 10, further comprising:

adding information indicating that the consumable item is used to information indicating that more consumable items are used out of information relating to use of the consumable item that is information stored in the storage device, and information on use of the consumable item that is information stored in the cartridge storage device.

12. The method according to claim 9, further comprising:

managing information on use of the consumable item in the management server when the cartridge is a genuine cartridge.

13. The method according to claim 12, further comprising:

limiting use of the consumable item when information on the use of the consumable item is larger than the threshold.

14. The method according to claim 9, further comprising:

limiting a function related to the consumable item in the image forming apparatus when information on use of the consumable item included in the cartridge attached to the image forming apparatus and a threshold related to the consumable item satisfy predetermined conditions.

15. The method according to claim 9, further comprising:

limiting a function indicating a consumption state of the consumable item when the cartridge is not a genuine cartridge.

16. The method according to claim 9, wherein the cartridge is a developer storage container, and the consumable item is a developer.

17. A cartridge including a consumable item comprising:

a storage device that stores information to be read to determine whether or not a predetermined condition indicating that the cartridge attached to an image forming apparatus is not a genuine cartridge is satisfied based on information on the consumable item or the cartridge in the image forming apparatus to which the cartridge is detachably attached.

18. The cartridge according to claim 17, wherein the consumable item comprises a developer.

19. The cartridge according to claim 17, wherein the consumable item comprises a toner.

20. The cartridge according to claim 17, further comprising:

the storage device includes an RFID tag and is configured to communicate with the image forming apparatus by using a wireless communication.

* * * * *